United States Patent [19]

Huang

[11] Patent Number: 5,031,326

[45] Date of Patent: Jul. 16, 1991

[54] BASIC FORMULA OF ACTIVE LAYOUT DRAWING IN PANTS TAILORING

[76] Inventor: Ding S. Huang, 5th Floor, No. 9-16, Lane 344, Nanking W. Rd., Taipei, Taiwan

[21] Appl. No.: 450,168

[22] Filed: Dec. 13, 1989

Related U.S. Application Data

[63] Continuation of Ser. No. 198,175, May 24, 1988, abandoned.

[51] Int. Cl.[5] ..... A41H 3/00

[52] U.S. Cl. ..... 33/17 R; 33/12

[58] Field of Search ..... 33/11, 12, 17 R, 17 A

[56] References Cited

U.S. PATENT DOCUMENTS

| | | | |
|---|---|---|---|
| 1,114,190 | 10/1914 | Scott | 33/17 R |
| 1,394,583 | 10/1921 | Serak | 33/12 |
| 1,416,383 | 5/1922 | Rose | 33/12 |
| 2,370,980 | 3/1945 | Magnet | 33/11 |
| 3,911,584 | 10/1975 | Ajus et al. | 33/17 R |
| 4,114,277 | 9/1978 | Chalker | 33/17 R |
| 4,222,170 | 9/1980 | Koontz | 33/17 R |
| 4,293,959 | 10/1981 | Gidello | 33/17 R |

FOREIGN PATENT DOCUMENTS

| | | | |
|---|---|---|---|
| 1410032 | 10/1968 | Fed. Rep. of Germany | 33/12 |
| 1213461 | 4/1960 | France | 33/17 R |
| 536468 | 12/1955 | Italy | 33/12 |
| 595536 | 7/1959 | Italy | 33/12 |
| 0673260 | 7/1979 | U.S.S.R. | 33/17 R |
| 0776596 | 11/1980 | U.S.S.R. | 33/17 A |

*Primary Examiner*—Thomas B. Will

*Attorney, Agent, or Firm*—Bucknam and Archer

[57] ABSTRACT

A basic formula of active layout drawing in pants tailoring to make use of all the data obtained from measure around the waistline, measure around the hip between waistline and hip, measure around the hip, front measure from waistline to gore bottom, back measure from waistline to gore bottom, measure of full gore line, measure around the upper thigh, measure around the middle thigh, measure around the knee, measure around the calf, and the determination of the position of the middle thigh for making an active layout drawing to fit all kinds of figures of the body.

2 Claims, 13 Drawing Sheets

BASIC FORMULA OF ACTIVE LAYOUT DRAWING IN PANTS TAILORING

This is a continuation, of application Serial No. 198,175, filed May 24, 1988, now abandoned.

BACKGROUND OF THE INVENTION

The present invention relates to a basic formula of an active layout drawing in pants tailoring, and more particularly, a basic formula to measure the figure of human body so as to alternatively fit the differences in body figure. Regular layout drawing in tailoring does not change and cannot help to discover the defect in body figure for compensation in advance, thereby misfits happen quite often and further alteration is usually required. Another object of the present invention is to provide an active layout drawing technique such that the dressmaker can easily handle with the variation in body figure while tailoring to prevent any further alteration.

DETAILED DESCRIPTION OF THE PREFERRED EMBODIMENT

Figure 1:
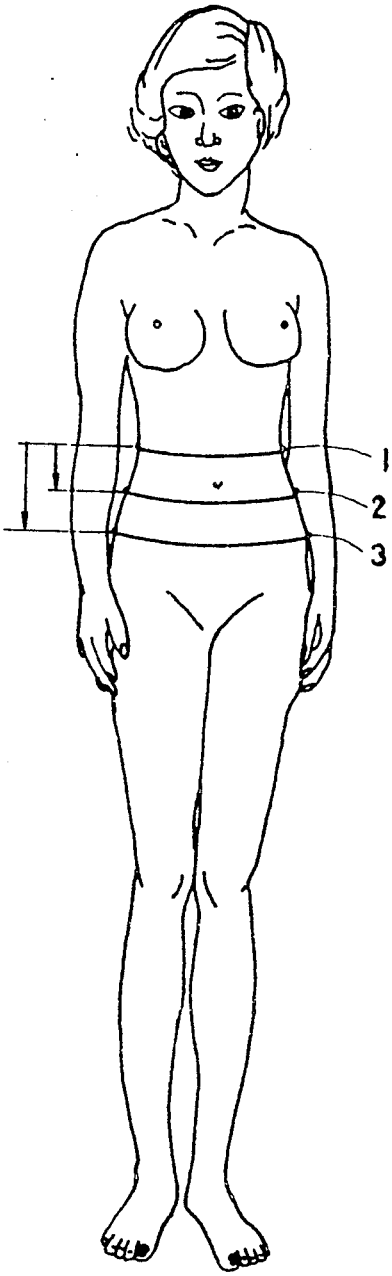
FIGS. 1–6 show the measuring technique applied according to the present invention.
Figure 2:
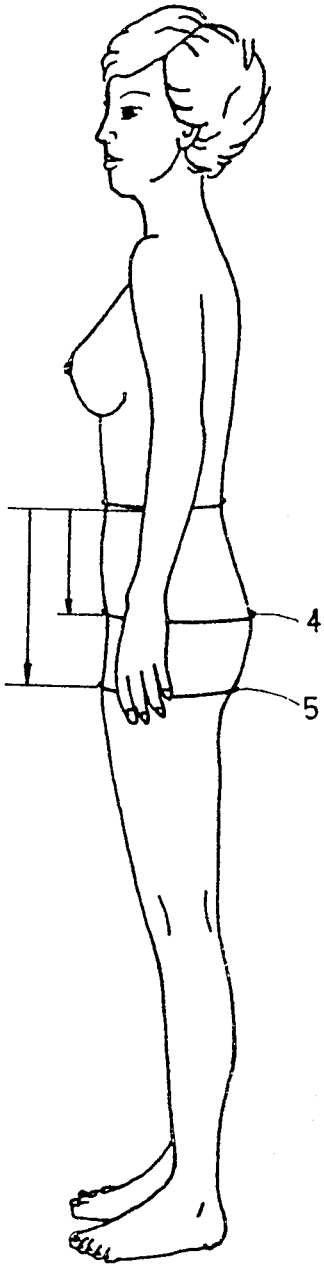

Please refer to FIGS. 1–6 regarding the measuring technique applied in the present invention. Measure around the waistline (1) (referring to FIG. 1): to measure at the front by fixing the position of the waistline. Measure around the lower waistline 1 (2): to measure at the front around the hip 5cm below the waistline. Measure around the lower waistline 2 (3): to measure at the front around the hip 10cm below the waistline. Measure around the hip (4) (referring to FIG. 2): to measure around the highest part of the hip. Then measure the depth from the waistline to the hip. Measure around the hip 2 (5): measure around the bottom of the hip. Then measure the depth from the waistline to the bottom of the hip. Measure of the front upper thigh (6) (referring to FIG. 3): to measure the depth from the waistline to the bottom of the gore at the front. Measure of back upper thigh (7): to measure the depth from the waistline to the bottom of the gore at the back. The size of the recession at the waistline is obtained by measuring the deflection from the vertical line along the back of the hip to the waistline. Measure of the full length of the gore (8) (referring to FIG. 4): to measure from the front waistline to the opposite side of the back waistline through the gore. Middle thigh positioning (9): to set at a point 12cm below the back gore. Measure around the middle thigh (10): to measure around the thigh from the point set by middle thigh positioning (9) and write down the depth from the waistline (1) to the middle thigh 10. Measure around the upper thigh (11): to measure around the upper leg from the point 2.5cm below the gore and write down the depth from the waistline to the upper thigh. Measure around the knee (12): to measure around the leg 4cm above the knee and write down the depth from the waistline. Measure around the calf (13): to measure around the largest part of the calf and write down the depth from the waistline. Measure around the ankle (14): to measure around the ankle and write down the depth from the waistline. Measure of the full length of the pants (15): to measure the full length of the pants laterally from the waistline to a length in accordance with requirement. Measure of the size of the recession at the middle thigh (16) (referring to FIG. 5): to measure from the vertical line along the abdomen to the middle thigh. Measure of the recession at the middle thigh of the middle aged (16) (referring to FIG. 6): to measure the recession from the vertical line along the abdomen to the middle thigh as above described.

Figure 3:
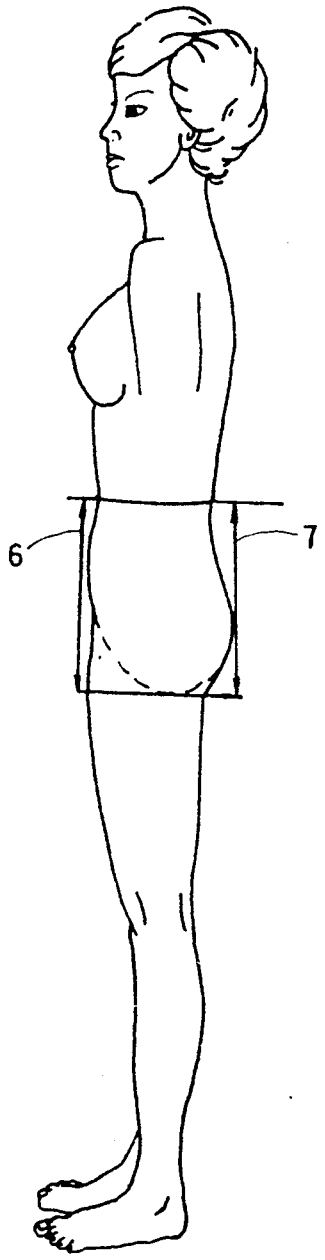
Figure 4:
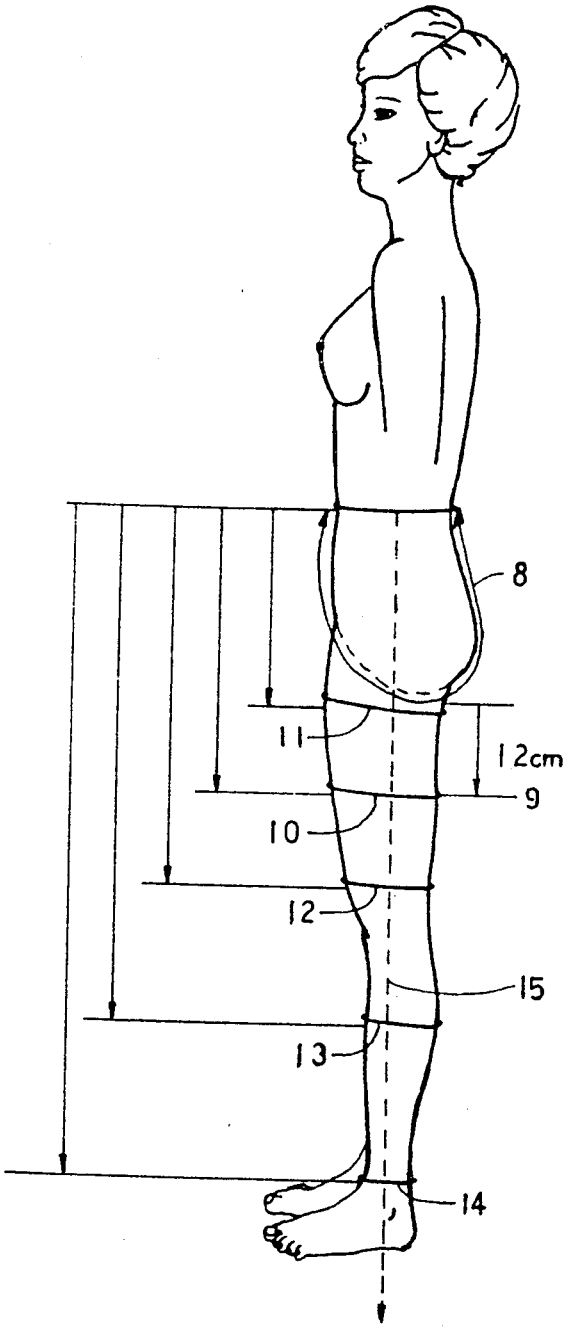
Figure 5:
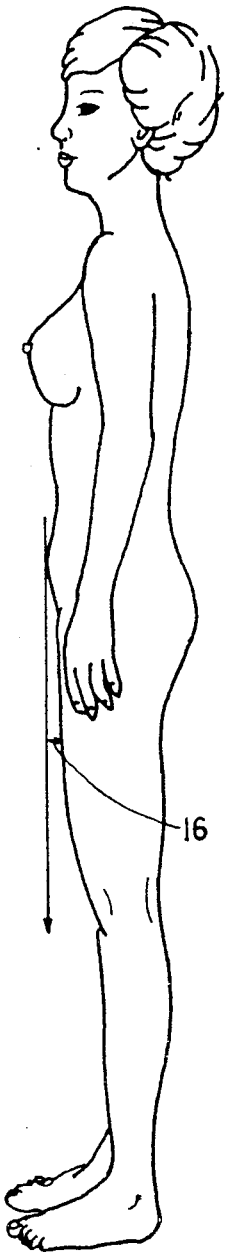
Figure 6:
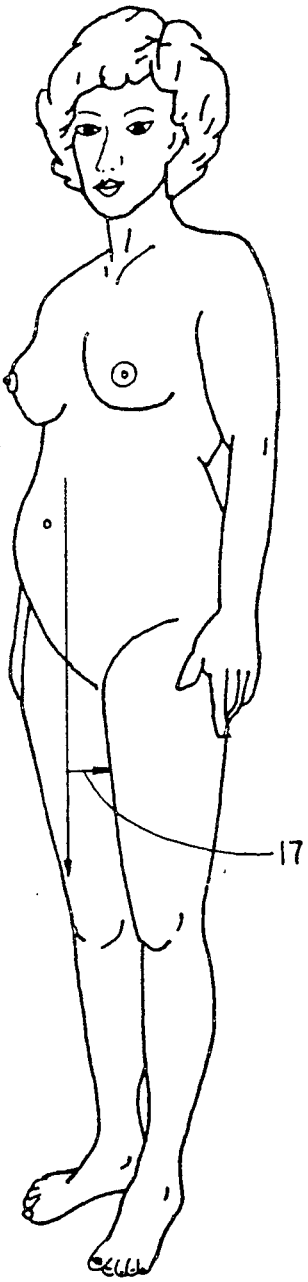
Figure 7:
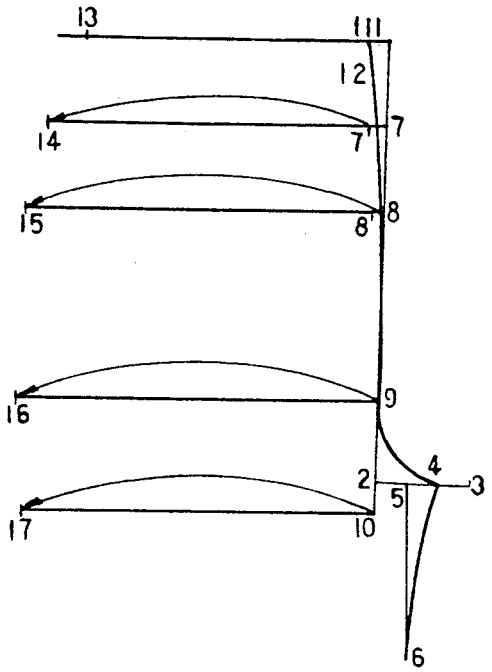
FIGS. 7–14 show the drawing process of the layout drawing technique according to the present invention.
Figure 8:
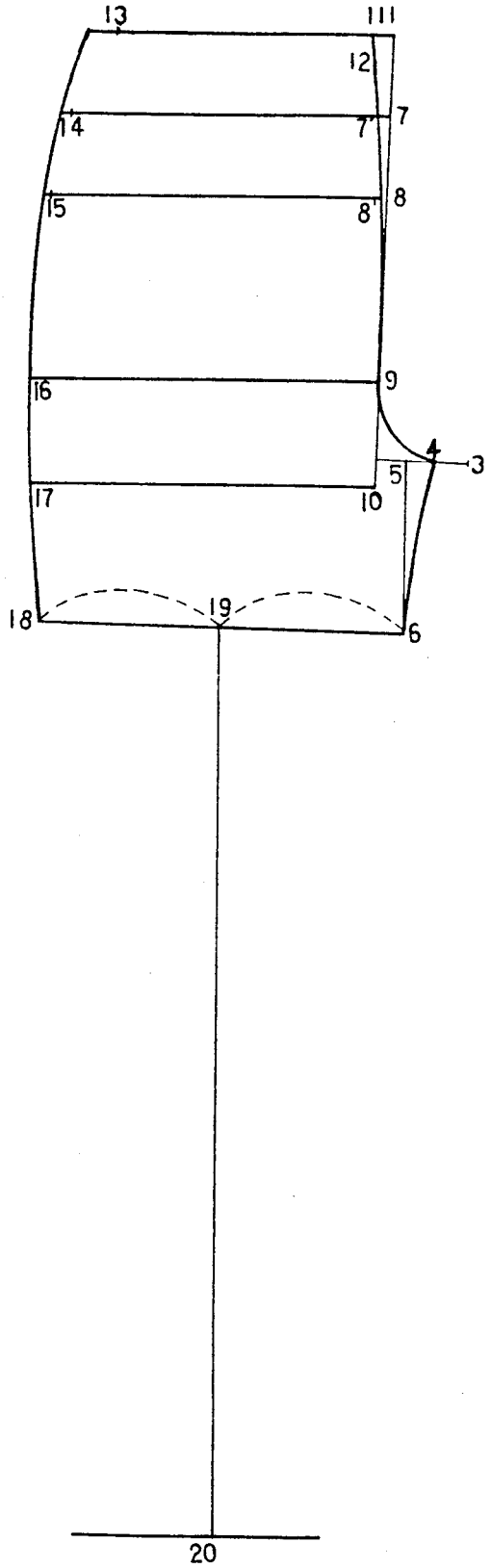
Figure 9:
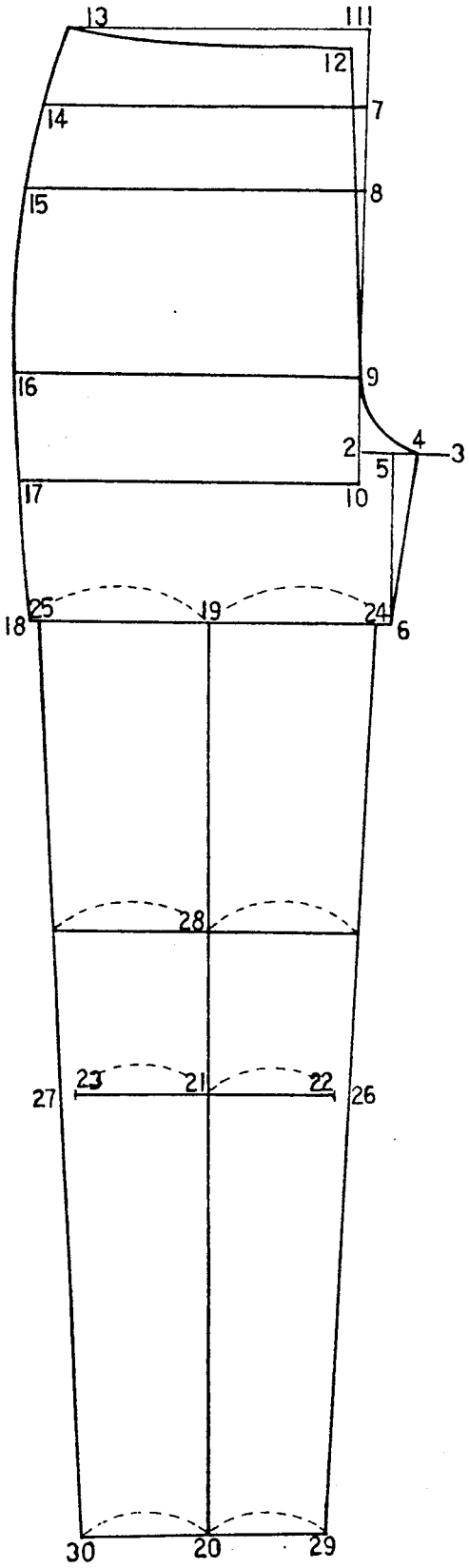
Figure 10:
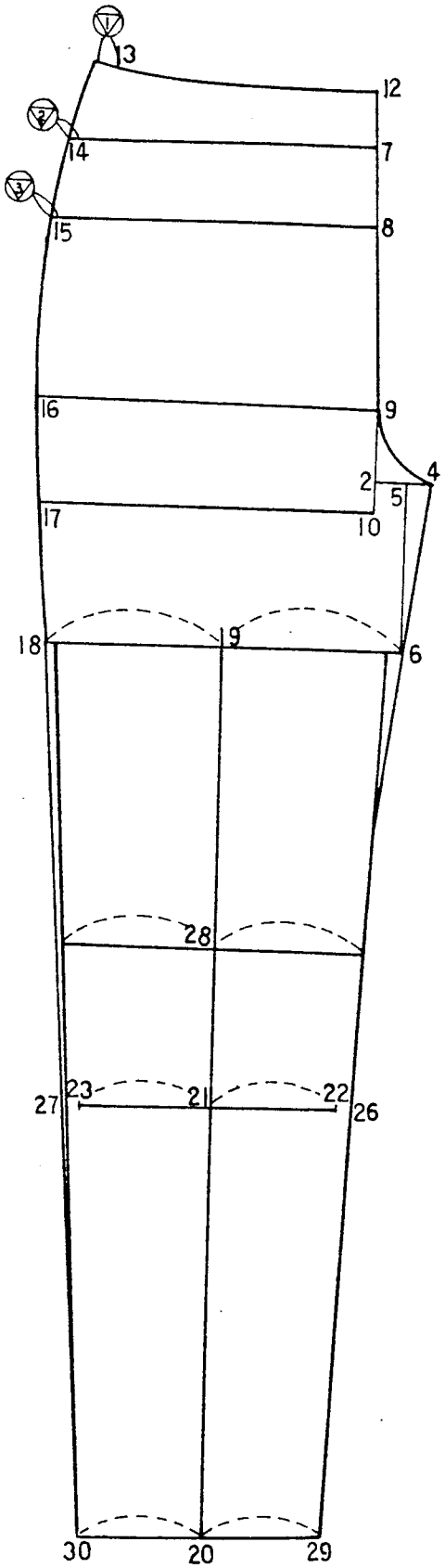
Figure 11:
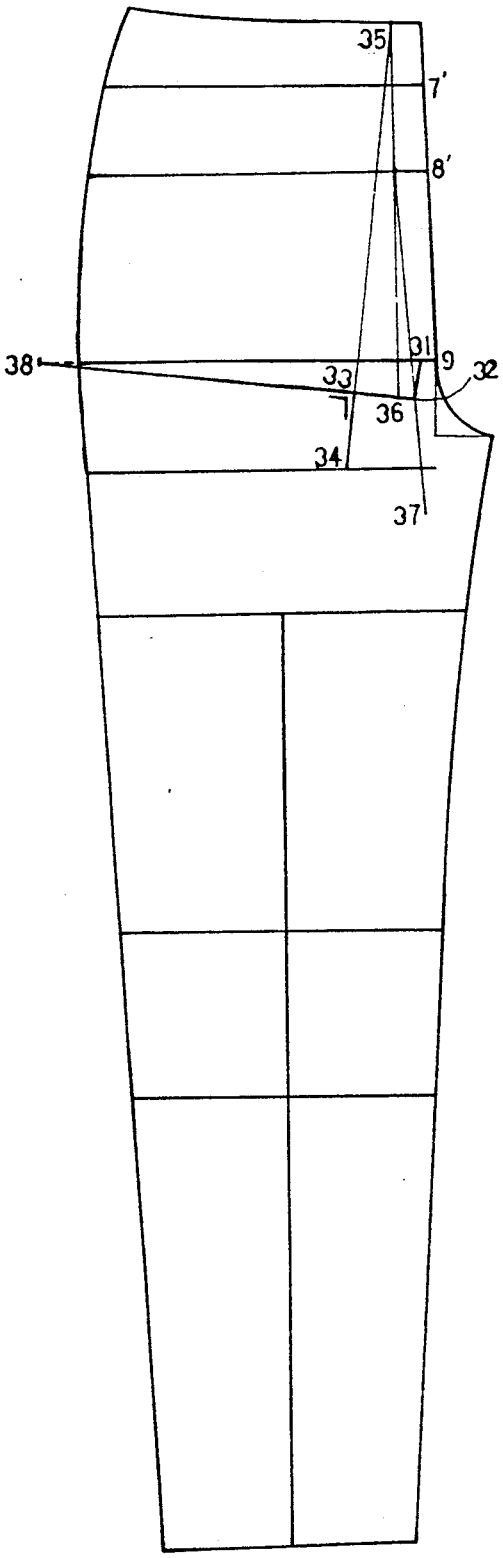
Figure 12:
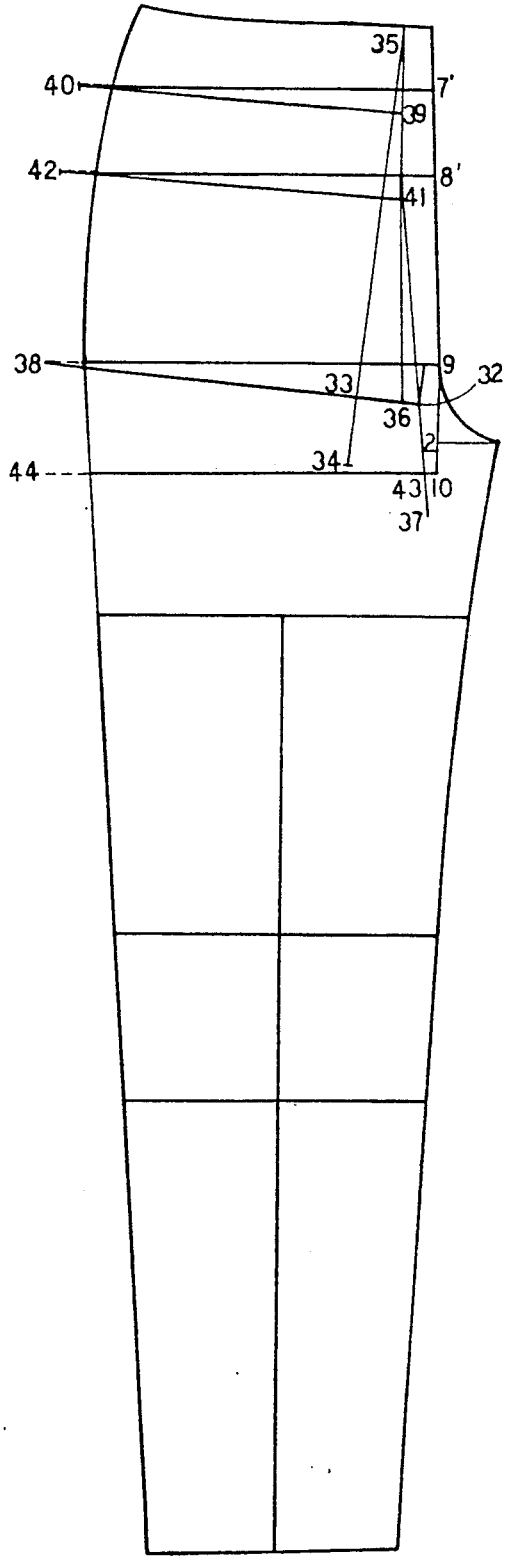
Figure 13:
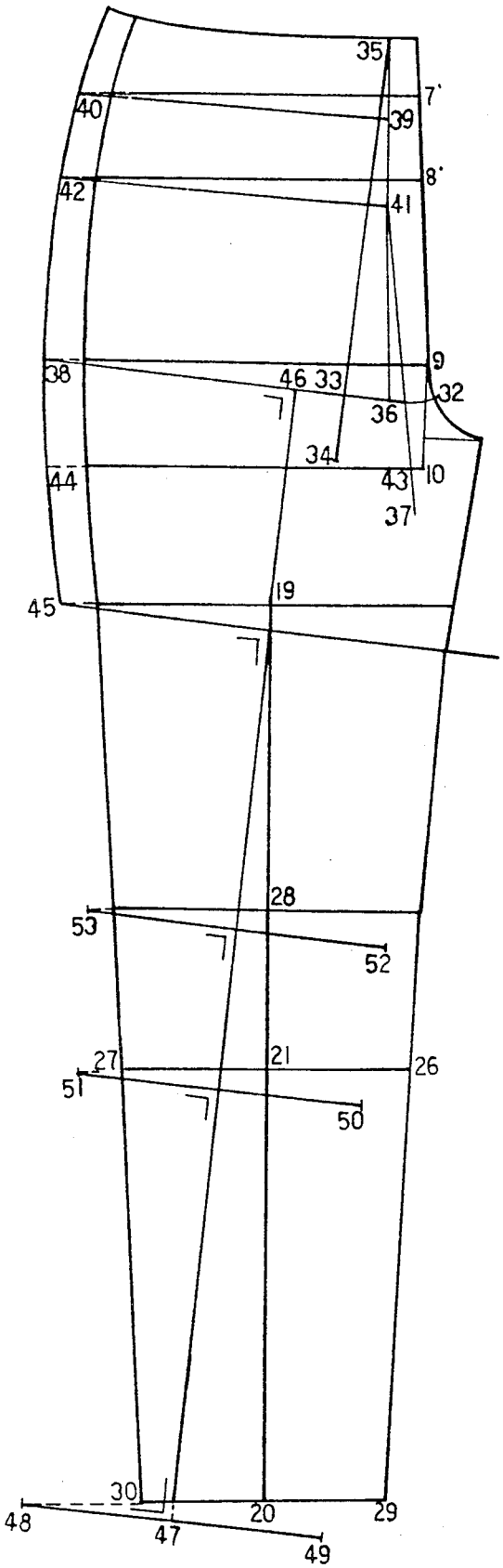
Figure 14:
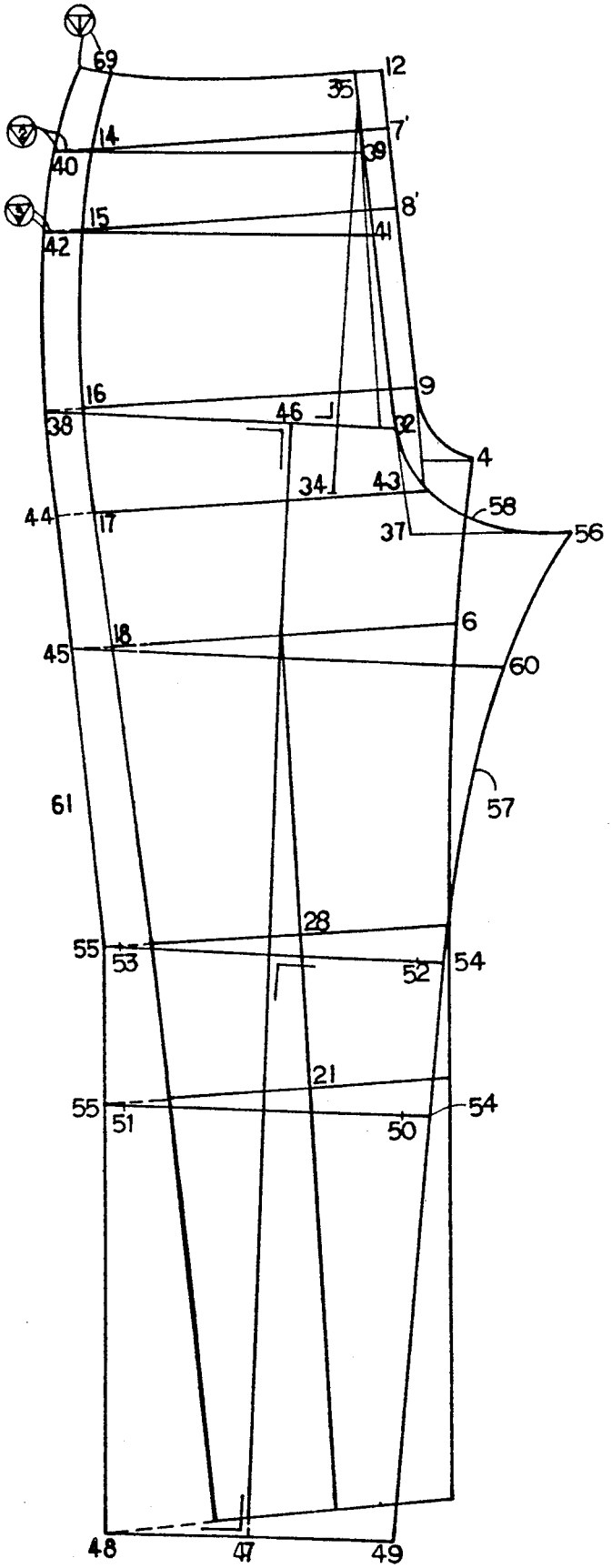
Figure 15:
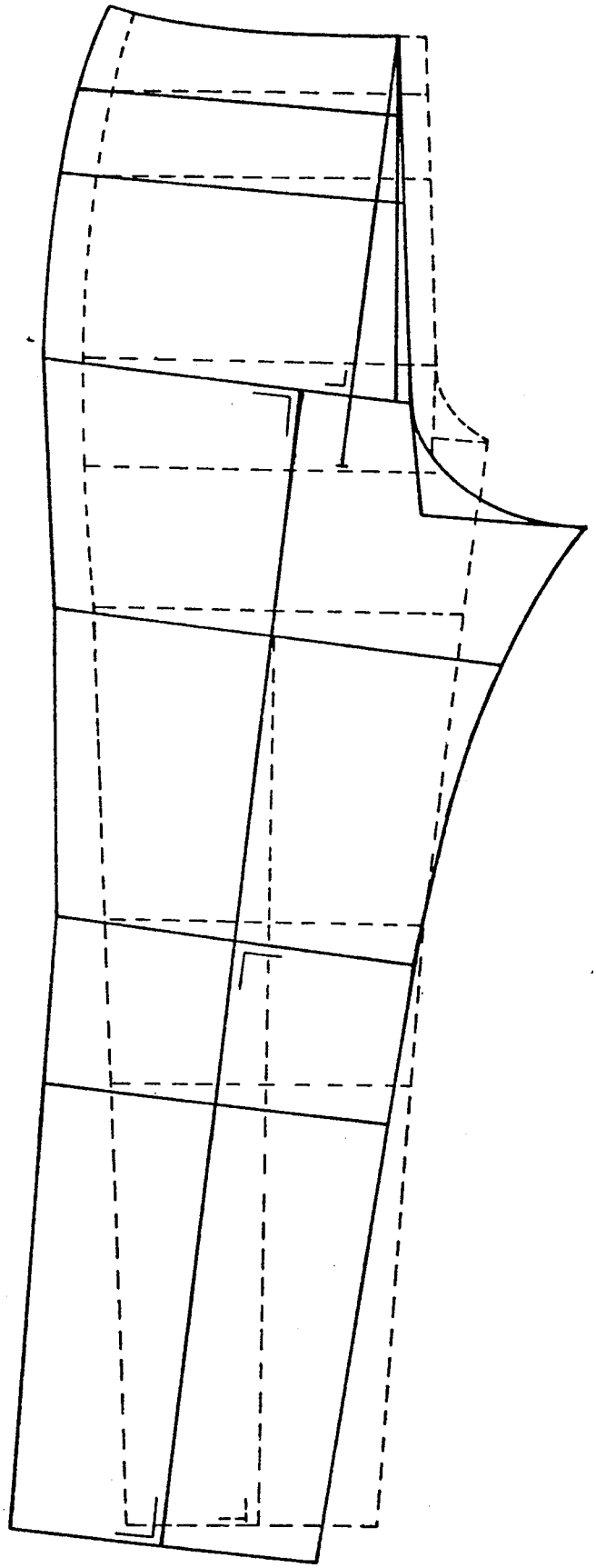
FIG. 15 shows a basic layout drawing obtained according to the present invention.
Figure 16:
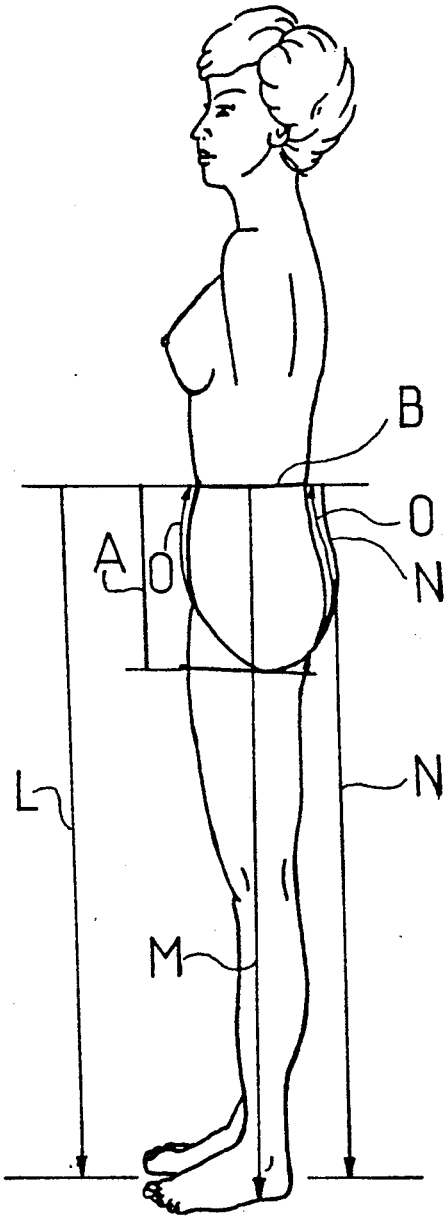
FIGS. 16–19 show the practical measure according to the present invention.
Figure 17:
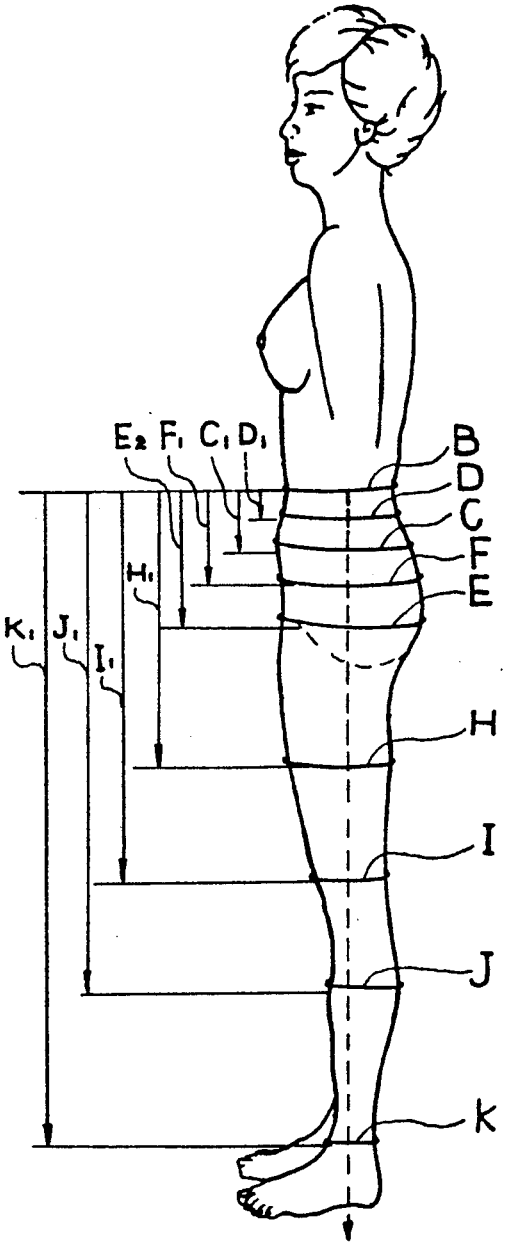
Figure 18:
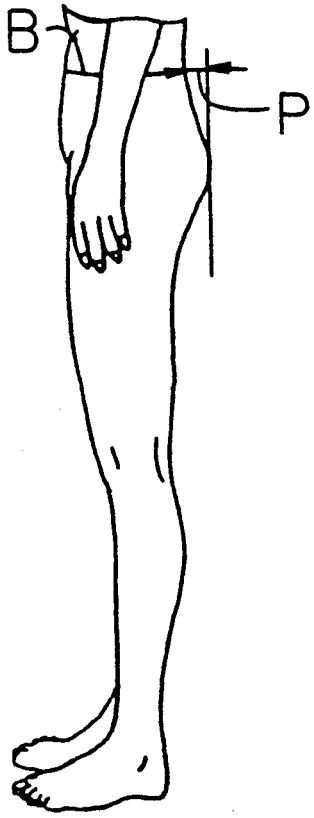
Figure 19:
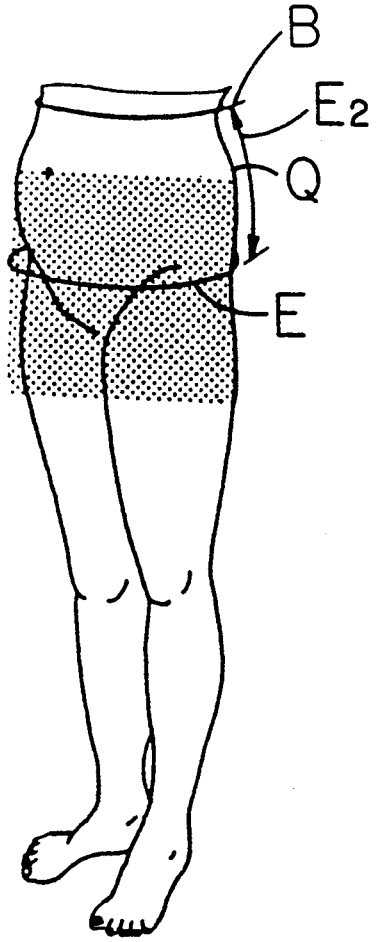

Use the data obtained from the above mentioned measuring technique to draw up a layout according to the formula described hereinafter: The basic layout drawing for the front piece is as shown in FIG. 7. Select a free point (1') to draw a vertical line and a horizontal line, then taking a fixed point (2') downward along the vertical line from the point (1') at a distance of the measure of the front upper thigh plus 2cm and draw a horizontal line from the fixed point (2'); measure a distance of 1/16 of the measure around the hip from the fixed point (2') rightward along the horizontal line to obtain a fixed point (3'), then set a fixed point (4') at 2cm leftward from the point (3') and set a fixed point (5') at 1.6cm leftward from the point (4'); draw a vertical line downward from the point (5') and obtain a point (6') at 12cm below the point (5'), then draw a curved line from the point (4') to the point (6'); set a point 7 at 5cm downward along the vertical line from the point (1') and draw a horizontal line from the point (7) for the measure around the lower waistline; set a point (8) at 10cm downward along the vertical line from the point (1') and draw a horizontal line from the point (8) for the measure around the second lower waistline; set a point (9) at 22cm downward along the vertical line from the point (1') and draw a horizontal line from the point (9) as for the measure around the hip (4); set a point (10) at 28cm downward along the vertical line from the point (1') and draw a horizontal line from the point (10) for the measure around the hip (4); set a point (11) leftward from the point (1') along the horizontal line at a distance of 1.5cm equal to the distance obtained from the size of the recession at the middle thigh (16), then draw a curved line from the point (11) to the point (9) and draw a front gore line from the point (9) to the point (4'); set a point (12) at 1.3cm downward along the curved line from the point (11) and obtain a cross point (7') and a cross point (8') at the respective cross points between the curved line from the point (11) and the horizontal line from the point (7) and the horizontal line from the point (8); set a point (13) at ¼ of the measure around the waistline leftward along the horizontal line from the point (11); set a point (14) at ¼ of the measure around the lower waistline (1), as shown in FIG. 1, leftward from the point (7') along the horizontal line of the point (7) (slack may be considered according to requirement): set a point (15) at ¼ of the measure around the lower waistline leftward from the point (8') along the horizontal line of the point (8) (slack may be considered according to requirement): set a point (16) leftward from the point (9) along the horizontal line at a distance equal to ¼ of the measure around the hip (4) plus the slack (1.3cm in the embodiment) and minus 1cm; set a point (17) leftward along the horizontal line from the point (10) at a distance equal to ¼ of the measure around the hip (4) plus the slack 1.3cm and minus 1cm; as shown in FIG. 8, draw a horizontal line leftward from the point (6') and use a curve to connect the points (13), (14), (15), (16), (17) and to obtain a point, (18) at the cross point with the horizontal line from point (6'); set point (19) at the center between point (6') and point (18), then draw a vertical line downward from the point (19), and then draw a horizontal line at point (20) according to the full length of the pants from the horizontal line emanating from the point (1')as shown in FIG. 9, set point (21) along the vertical line from the point (19) from the horizontal line of the point (1') according to the depth from the waistline to the calf line and draw a horizontal line through the point (21) thus obtained, then set points (22) and (23) at ¼ of the measure around the calf leftward and rightward respectively along the horizontal line through the point (21): set points (24) and (25) at 1cm inward respectively from point (6') and point (18); set points (26) and (27) at 1cm extending outward respectively from the points (22) and (23) along the horizontal line: set a point (28) along the vertical line through the point (19) from the horizontal line of the point (1') according to the depth from the waistline to the knee, and draw a horizontal line through the point (28) as a line for the measure around the knee; draw a line to connect points (24) and (26) and another line to connect points (25) and (27) so as to obtain points (30) and (29) at the respective cross points with the horizontal line of the point (20) as shown in FIG. 10, draw a line through point (6') and another line through point (18) to connect points (26) and (29) and points (27) and (30) respectively so as to complete the internal side line and the external side line, and the area beyond the points (13), (14) and (15) is prepared for folding; the layout drawing process for the back piece is as shown in FIG. 11, set a point (31) at 1.3cm leftward from the point (9) along the horizontal line emanating therefrom, then draw a line from the point (31), and set a point (32) at 2.5cm below the point (31) along the vertical line emanating therefrom; draw a line from the point (32) to incline leftward in a length equal to 1cm+¼ of the measure around the hip+1.3cm and to cross with the horizontal line emanating from the point(9) so as to obtain a point (38): set a point (33) leftward along the inclined line emanating the point (32) at a distance equal to the measure of the horizontal recession or deviation at the back waistline (1) as shown in FIG. 3, and as obtained from a line tangential to the back upper thigh (7), then draw a line through the point (33) to cross the line between the point (32) and the point (38), and set a point (34) downward along this line at a distance equal to the distance between points (9) and (2'), then set a point (35) upward along the vertical line at a distance equal to the measure of the back upper thigh+2.5cm: set a point (36) at 1cm leftward from the point (32) and draw a line to connect points (36) and (35), then set a point (37) at 8cm from the point (36) where the line that extends from points (35) and (31) is passing through: please refer to FIG. 12, set a point (39) below the point (35) at a distance equal to the distance between point (1') and point (7), and draw a line through the point (39) for the position of the lower waistline of the back piece, then draw a line from the point (39) upwardly inclining to the left to a distance equal to ¼ of the measure around the lower waistline to cross with the horizontal line of the point (7') so as to obtain a cross point (40); set a point (41) below the point (35) at a distance equal to the distance between points (1') and (8), and draw a line through the point (41) for the position of the lower waistline of the back piece, then draw a line from the point (41) upwardly inclining upper to the left to a distance equal to 0.5cm+¼ of the measure around the lower waistline to cross with the horizontal line from the point (8') so as to obtain a cross point (42); draw a line through the point (41) and the point (32) to cross with the horizontal line from the point (10) so as to obtain a cross point (43), set a point (44) leftward along the horizontal line from the point (10) at a distance equal to 1cm+(¼ of the measure around the hip+1.3cm). Refer to FIG. 13, draw a side line to connect points (40), (42), (38), (44) and to obtain a cross point (45) against the horizontal line from the point (19): draw a line upwardly and downwardly through point (19) to cross the line between points (38) and (32) to obtain a cross point (46) and another cross point (47) at the bottom, the point (47) is the center point of the bottom leg of the back piece of the pants: draw a central line to connect points (46) and (47) and then draw a line through the point (47) and obtain the cross point (48) between the line through the point (47) leftward from the point (47) at a distance equal to 2cm +the distance between points (20) and (30). Point (49) is obtained at the right from point (47). Measure the distance between points (21) and (27) then use a triangle to draw an inclined line vertically against the center line so as to obtain a cross point (51) at the extension of the horizontal line through the point (21) and also to obtain an opposite point (50) rightward from point (51) in equal distance: in the same manner described above obtain a point (52) and a point (53) from the line through the point (28); please refer to FIG. 14, set points (54') and (55') along the line through points (52) an (53) and set points (54) and (55) along the line through points (50) and (51) at a location 2cm outward bilaterally (the extension of 2cm is adjustable according to requirement): draw a line extending rightward from the point (37) to a position equal to the distance of ⅛ of the measure around the hip (4) minus 1.3cm so as to obtain a point (56): draw an internal back side line (57) to connect the point (56) and the point (54') draw an initially straight and thereafter convexly curved back gore line (58) to connect points (35), (39), (41), (32) and (56), (the location of the point (56) is adjustable to keep the back gore line in accordance with the measure of the full gore length); draw a line from the point (45) parallel with the line connecting the points (54) and (55) to cross with the internal back side line (57) so as to obtain a cross point (60), and the distance between points (45) and (60) indicates the width of the back piece; draw a front side line (61) to connect points (45) (55'), (55) and 48 as to complete the layout drawing of the basic model for pants tailoring as shown in FIGS. 14 and 15.

Figure 20:
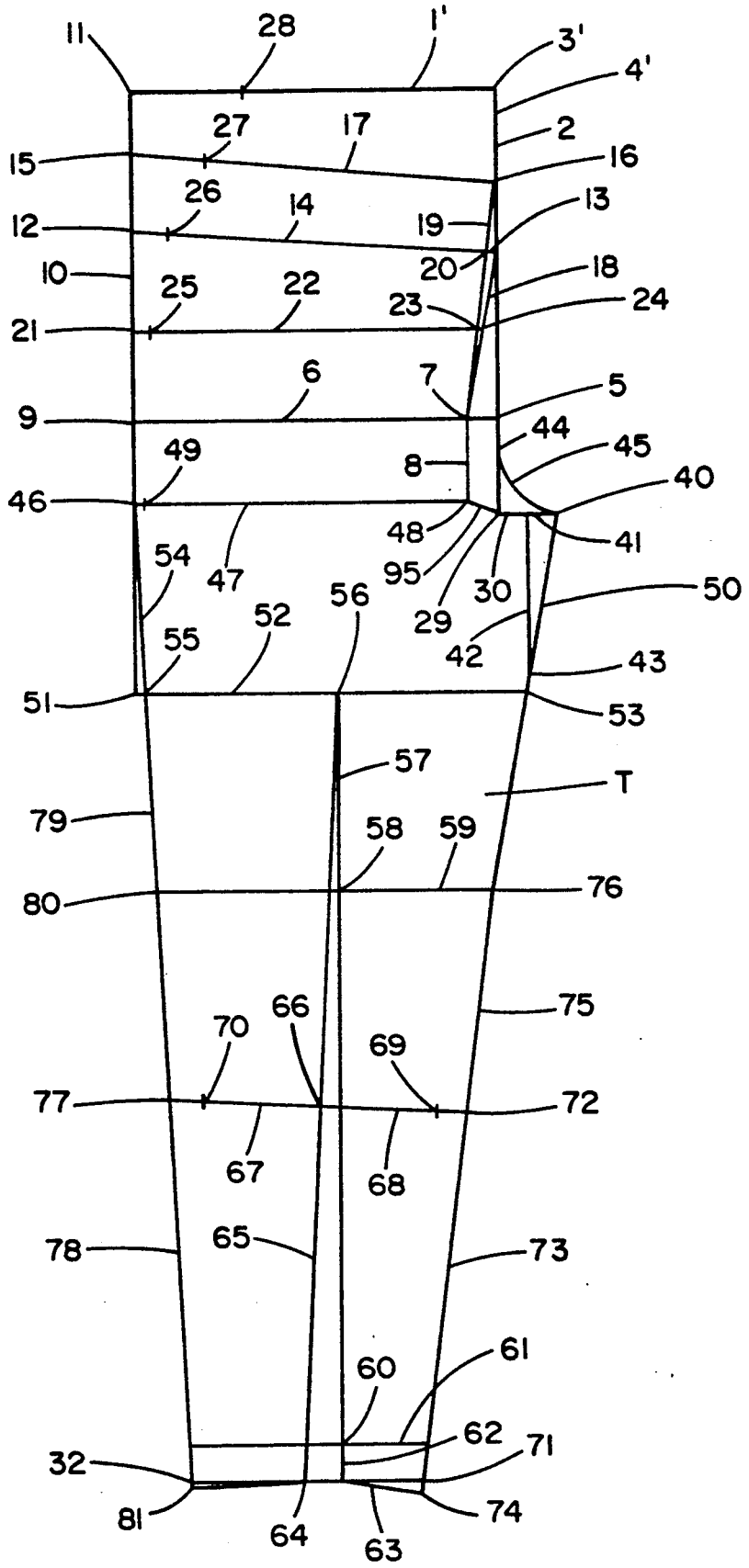
FIG. 20 shows the completion of the layout drawing of the front piece in pants tailoring according to the present invention.

Please refer to the practical measure as shown in FIGS. 16–19. In the present preferred embodiment, the features of the practical measure are described hereinafter: Measure of the depth of the gore (A): from the horizontal of the bottom of the gore to the waistline (27cm in the embodiment). Measure around the waistline (B): one circle around the waistline (72cm in the embodiment). Measure around the abdomen (C): one circle around the extruding part of the abdomen (92cm in the embodiment). The depth from the waistline (B) to the abdomen (C) is the depth (C1) (10cm in the embodiment). Measure around the abdomen (D): one circle around the abdomen between the waistline (B) and the abdomen (C). The depth from the waistline (B) to the abdomen (D) is the depth (D1) (5cm in the embodiment). Measure around a central hip (E): one circle around the largest part of the hip (E) (96cm in the embodiment). The circle around the bottom of the the central hip (E) from an extruding point of the abdomen is the measure (E1) (100cm in the embodiment). The depth from the waistline (B) to the central hip (E) is the depth (E2) (23cm in the embodiment). Measure around the hip (F): one circle around the hip between the hip line (E) and the abdomen (C) (95cm in the embodiment). The depth from the waistline (B) to the hip line (F) Is the depth (F1) (17 cm in the embodiment). Measure around the hip (G): one circle around the hip at the bottom of the gore (94cm in the embodiment). The depth from the waistline to the hip (G) is the depth (G1) (29cm in the embodiment). Measure around the middle thigh (H): one circle around the leg between the knee and the bottom of the gore (48cm in the embodiment). The depth from the waistline to the middle thigh (H) is the depth (H1) (42cm in the embodiment). Measure around the knee (I): one circle around the knee (37 cm in the embodiment). The depth from the waistline to the knee (I) is the depth 7 (I1) (56cm in the embodiment). Measure around the calf (J): one circle around the largest part of the calf (33cm in the embodiment). The depth from the waistline to the calf (J) is the depth (J1) (71cm in the embodiment). Measure around the ankle (K): one circle around the ankle (23cm in the embodiment). The depth from the waistline to the ankle (K) is the depth (K1) (94cm in the embodiment). Measure of the front length (L): from the front of the waistline (B) downward vertically to the horizontal line (97.5cm in the embodiment). Measure of the side length (M): from one side of the waistline (B) downward vertically to the plane of the horizontal line (99.5cm in the embodiment). Measure of the back length (N): from the back of the waistline (B) downward vertically to the horizontal line (97.5cm in the embodiment). Measure of the full length of the gore (0): from the front of the waistline through the bottom of the gore to the back of the waistline (72.5cm in the embodiment). Measure of the recession at the back waistline (P): the depth of the recession at the back waistline in comparison with the hip line (4cm in the embodiment). Measure of side curve (Q): measure the curve laterally along the waistline, abdomen, hip to the thigh for reference in layout drawing. Please refer to the basic model (T) of the front piece as shown in FIG. 20. Draw a horizontal line (1') on the upper side and draw a vertical line (2') against the horizontal line (1') to cross each other at the right side at a cross point (3'); set a point (4') downward along the vertical line (2') at a location equal to the difference between the front length (L) and the side length (M) (2cm): set a point (5') downward along the vertical line (2') at a location equal to the distance of the depth (E2) (23cm); draw a horizontal line (6') leftward from the point, (5') and set a point (7') leftward along the horizontal line (6') at a distance equal to ½ of the difference between the measure of (E) and the measure of (E1) (2cm): set a point (9) leftward along the horizontal line (6') from the point (7') at a distance equal to ¼ of the measure (E) (24cm), then draw a vertical line (10') through the point (9) to cross with the horizontal line (1') at the point (11'); set a point (12') and a point (13') respectively downward along the vertical line (10') and (2') from the point (11') and the point (4') at a distance equal to the depth (C1) (10cm) and draw a line (14') to connect points (12') and (13'): set a point (15') and a point (16') respectively downward along the vertical line (10') and the line (2') from the point (11') and the point (4') at a distance equal to the depth (D1) (5cm) and draw a line (17) to connect the point (15') and the point (16'); draw an oblique line (18) to connect the point (13') and the point (7') and another oblique line (19) to connect the point (16') and the point (7') so as to obtain a cross point (20) on the horizontal line (14'): set a point (21) downward along the vertical line (10') from the point (11') at a distance equal to the depth (F1), then draw a horizontal line (22) rightward from the point (21) to respectively cross with the oblique lines (18) and (19) at the cross points (24) and (23): set a point (25) leftward along the horizontal line (22) from the point (23) or (24) at a distance equal to ¼ of the measure (F) (¼ of 95cm=23.75cm); set a point (26) leftward along the horizontal line (14') from the point (20) or (13') at a distance equal to ¼ of the measure (G) (¼ of 92cm=23cm); set a point (27) leftward along the horizontal line (17) from the point (16') at a distance equal to ¼ of the measure (D) (¼ of 85cm=21cm): set a point (28) along the horizontal line (1') at a distance from the point (3') equal to ¼ of the measure (B) 91/4 of 72cm=18cm); set a point (29) downward along the vertical line (2') from the point (14') at a distance equal to 0.5cm+the measure (A) (27cm) and draw a horizontal line (30) rightward from the point (29) and then set a point (40) rightward along the horizontal line (30) at a distance equal to 1/24 of the measure (E); set a point (41) along the horizontal line (30) about 2cm leftward from the point (40) and draw a vertical line (42) downward from the point (41), then set a point (43) along the vertical line (42) at 13.5cm from the point (41); set a point (44) upward along the vertical line (2') from the point (29) at a distance equal to 1/16 of the measure (E) minus 1cm draw a curved line (45) to connect the point (44) and the point (40); set a point (46) along the vertical line (10') downward from the point (11') at a distance equal to the depth (G1) (29cm) and then draw a horizontal line (47) rightward from the point (46) to cross with the line (8') from the point (7') at a cross point (48): set a point (49) along the horizontal line (47) leftward from the point (48) at a distance equal to ¼ of the measure (G) (¼ of 94cm=23.5cm); draw a line (50) from the point (40) passing through the point (43); set a point (51) along the vertical line (10') downward from the point (11') at a distance equal to the depth (H1) (42cm), then draw a horizontal line (52) rightward from the point (51) to cross with the line (50) at a cross point (53); draw a line (54) from the point (9) passing through the point (46) or (49) to cross with the horizontal line (52) at a cross point (55); set a point (56) at the center between the center between the point (55) and the point (53) along the horizontal line (52) and draw a vertical line (57) downward from the point (56) to the horizontal line determined for the bottom of the pants; set a point (58) along the vertical line (57) at a distance equal to the depth (I1) from the horizontal line (1') (56cm) and then draw a horizontal line (59) through the point (58): set a point (60) along the vertical line (57) at a distance equal to the depth (K1) from the horizontal line (1') and then draw a horizontal line (61) through the point (60): set a point (62) at 2.5cm below the point (60) along the vertical line (57) and draw a line (63) horizontally through the point (62); set a point (64) at 2cm (more or less according to requirement) leftward from the point (62) along the horizontal line (63) and then draw a line (65) to connect the point (56) and the point (64); set a point (66) downward along the vertical line (65) from the horizontal line (1') at a distance equal to the depth (J1) and draw a line (67) and another line (68) through the point (66) and another line (65) to join (66) and (64), then set the left point (70) and the right point (69) along the lines (67) and (68) respectively from the point (66) at a distance equal to ¼ of the measure (J) (¼ of 33cm=8.25cm); set a point (32) and a point (71) respectively along the horizontal line (63) from the point (64) at a distance of 8.5cm in the embodiment; set a point (72) rightward from the point (69) along the line (68) at the preferred distance (2cm in the embodiment) and draw an oblique line (73) to connect the point (71) and the point (72), then use a triangle with one side close to the oblique line (73) and another side aimed at the point (64) to draw a line through the point (64) vertically against the oblique line (73) so as to obtain a cross point (74); draw a line to connect the oblique line (73) and the line (50) so as to complete the internal side line (75) for the front piece; the cross point between the internal side line (75) and the horizontal line (59) is the point (76): set a point (77) at a preferred distance (2cm in the embodiment) leftward from the point (70) along the line (67) and draw a line (78) to connect the point (32) and the point (77), then draw line (54) from the point (46) on the vertical line (10') passing through the point (55) and draw another line (79) extending upwardly the line (78) so as to complete the external side line, thus a cross point (80) is obtained between the line (79) and the horizontal line (59): use a triangle with one side close to the line (78) through the point (32) and with another side aimed at the point (64) to draw a horizontal line passing through the point (64) so as to obtain a cross point (81).

Figure 21:
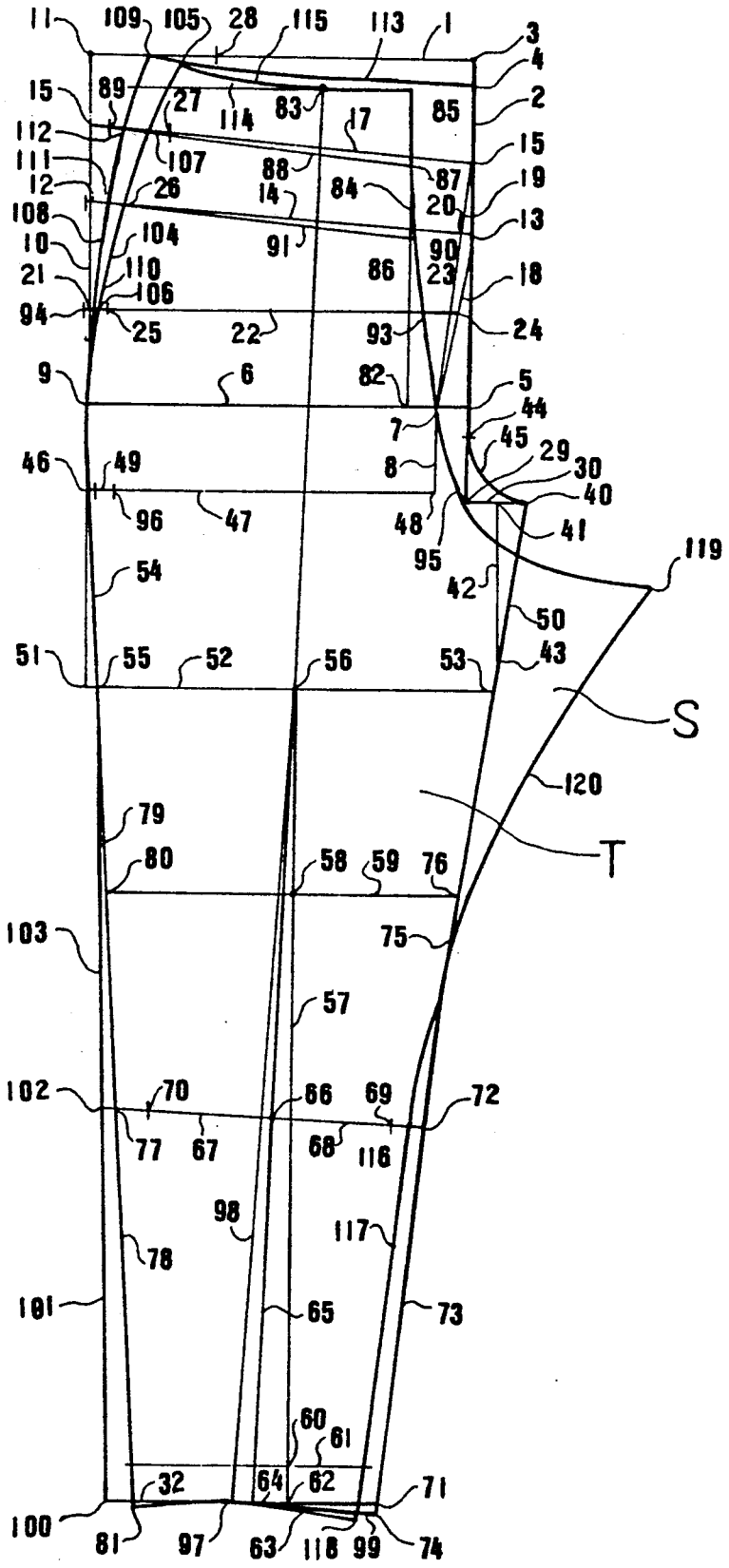
FIG. 21 shows the completion of the layout drawing of the back piece in pants tailoring according to the present invention.

Please refer to the following description accompanying FIG. 21: set a point (82) leftward from the point (7') along the horizontal line (6') at a distance equal to ⅔ of the measure (P) (⅔ of 4cm=2cm): set a point (83) below the horizontal line (1') along the vertical line through the point (56) at a distance equal to the difference between the measure (N) and the measure (M) (99.5cm minus 97.5cm=2cm), then use a triangle with one side close to the point (83) and with the opposite side close to the point (82) draw a horizontal line (121) and a vertical line (84) so as to obtain a cross point (85); draw a curved line close to the vertical line (84) from a point 4cm below the point (85) passing through the point (7') to form a gore line (86) for the back piece; set a point (87) downward from the point (85) at a distance equal to the measure (D1) and draw an inclined line (88) to connect the points (87) and (15), then set a point (89) leftward from the point (87) along the inclined line (88) at a distance ¼ of the measure (D) (¼ of 84cm=21cm); set a point (90) downward from the point (85) along the line (86) at a distance equal to the measure (C1) (10cm) then draw an inclined line (91) to the point (12'), then set a point (92) leftward from the point (90) along the line (91) at a distance equal to ¼ of the measure (C) (¼ of 92cm=23cm): set a cross point (93) between the gore line (86) and the horizontal line (22) and then set a point (94) leftward from the point (93) along the line (22) at a distance equal to ¼ of the measure (F) (¼ of 95cm=23.75cm); set a cross point (95) between the gore line (86) and the horizontal line (47), then set a point (96) leftward from the point (95) along the horizontal line (47) at a distance equal to ¼ of the measure (G) (¼ of 94cm=23.5cm); set a point (97) leftward from the point (64) along the horizontal line (63) at a preferred distance (1.5cm in the embodiment) and draw an oblique line (98) from the point (56) to the point (97): draw a line to connect the point (97) and the point (74) and set a point (99) at a preferred distance (8.5cm in the embodiment from the point 97), then set a point (100) leftward from the point (97) along the line (63) at a preferred distance (8.5cm in the embodiment): set a point (102) leftward from the point (77) along the line (67) extending through the point (77) at a preferred distance (same distance between point (66) and point (77) in the front piece), then draw a straight line (101) to connect the points (100) and (102) and draw a side line (103) to prolong the side line (54) downwardly and the straight line (101) up to the point (9): draw a curved line (104) to connect the points (26) and (9) according to the distance equal to ¼ of the measure (C) to obtain a right size for the waistline: set a cross point of the curved line (104) and the horizontal line (1') as point (105); set the cross point of the curved line (104) and the lines (88) and (17) as point (107): draw a side line (108) from the point (9) to the horizontal line (1') for the front piece as well as for the back piece within a preferred range set the cross point of the side line (108) and the horizontal line (1') as point (109); set the cross point of the side line (108) and the horizontal line (22) as point (110), set the cross point of the side line (108) and the inclined lines (14') and (91) as point (111), and set the cross point of the side line (108) and the inclined lines (17) and (88) as point (112); draw a curved line (113) with a curve to connect the points (4') and (109); use a triangle with one side close to the side line (108) and with another side crossing through the horizontal line of the point (83) letting the right angle aimed at the point (109) to draw a line (114) from the point (109) to the horizontal line (121) from the point (83), then draw a curved line (115) to connect the horizontal line (121) of the point (83) and the line (114): set a point (116) rightward from the cross point of the line (68) and the line (98) along the line (68) at a preferred distance (same size as the distance between point (66) and point (77) in the front piece), then draw a straight line (117) to connect the points (99) and (116), then use a triangle with one side close to the line (117) and with another side aimed at the point (97) to draw a bottom line (122); according to the distance equal to the difference between the measure (0) (72cm in the embodiment) and the length of the gore in the front piece (30cm), draw a line from the point (4') through the point (44) to connect the curved line (45) up to the point (44); according to the length of the gore in the back piece (42cm in the embodiment) draw a line from the point (85) through the line (86), the point (87), the point (90), the point (93) and the point (7') and extending outward to a point (119) in an arch shape to complete a gore line for the back piece; according to the internal side length of the front piece, draw a line from the point (74) through the point (72) to connect the line (43) up to the point (40) so as to complete an internal side line (123) for the back piece (68cm in the embodiment), then, according to the distance equal to the internal side length of the front piece minus 1.5cm (68cm minus 1.5cm=66.5cm) draw a curved line from the point (118) through the point (116) to connect with the point (119) so as to complete an internal side line (120) for the back piece, thus the basic model (S) for the back piece is completed.

I claim:

1. The method of preparing a layout drawing in pants tailoring, by means of a measure around the waist line (1), a measure around a first lower waist line (2) 5 cm below the waist line (1), a measure around a second lower waist line (3) 10 cm below the waist line (1), a measure around the hip (4), a measure around the bottom of the hip (5), a measure of the front upper thigh (6), a measure of the back upper thigh (7), a measure of the full gore (8), a measure around the middle thigh (9), a measure around the knee (12), a measure around the calf (13), a predetermine depth extending from the waist line (1) to the calf (13), a measure around the ankle (14), a measure of the full length of the pants (15), a measure of the size of the deviation at the middle thigh (16) from the vertical tangential to the abdomen, comprising the steps of:

selecting a free point (1');

drawing a vertical line and a horizontal line therefrom; then taking a fixed point (2') downward along said vertical line from the point (1') at a distance of the measure of the front upper thigh (6) plus 2 cm;

drawing a horizontal line from said fixed point (2');

measuring a distance of 1/16 of the measure around the hip (4) from the fixed point (2') rightward along a horizontal line originating therefrom to obtain a fixed point (3'); then setting a fixed point (4') at 2 cm leftward from the point (3');

setting a fixed point (5') at 1.6 cm leftward from said point (4');

drawing a vertical line downward from the point (5') to obtain a point (6') at 12 cm below the point (5'); then drawing a curved line from the point (4') downwardly to the point (6');

setting a point (7) at 5 cm downward along the vertical line emanating from the point (1');

drawing a horizontal line from the point (7) leftwardly for the measure around the lower waist line (2);

setting a point (8) at 10 cm downwardly along the vertical line emanating from the point (1');

drawing a horizontal line leftwardly from the point (8) for the measure around the second lower waist line (3);

setting a point (9) at 22 cm downwardly along the vertical line emanating from the point (1');

drawing a horizontal line leftwardly from the point (9) for the measure around the hip (4);

setting a point (10) at 28 cm downwardly along the vertical line emanating from the point (1');

drawing a horizontal line leftwardly from the point (10) for the measure around the bottom of the hip (5);

setting a point (11) leftwardly from the point (1') along the horizontal line emanating from the point (1') at a distance of 1.5 cm and equal to the size of the deviation at the middle thigh (16) from the vertical tangential to the abdomen;

drawing a curved line from the point (11) to the point (9);

drawing a front gore line from the point (9) to the point (4');

setting a point (12) at 1.3 cm downward along the curved line emanating form the point (11) so as to obtain respective intersection points (7') and (8') between the curved line emanating from the point (11) on one hand, and the horizontal lines emanating from the points (7) and (8), on the other hand;

setting a point (13) at ¼ of the measure around the waist line (1) leftward along the horizontal line emanating from the point (11);

setting a point (14) at ¼ of the measure around the first lower waist line (2) leftward from the point (7') along the horizontal line emanating from the point (7);

setting a point (15) at ¼ of the measure around the second lower waist line (3) leftward from the point (8') along the horizontal line emanating from the point (8);

setting a point (16) leftward from the point (9) along the horizontal line emanating from he point (9) at a distance equal to ¼ of the measure around the hip (4) plus a slack of 1.3 cm and plus/minus 1 cm;

setting a point (17) leftward along the horizontal line emanating rom the point (10) at a distance equal to ¼ of the measure around the hip (4) plus a slack of 1.3 cm and plus/ minus 1 cm;

drawing a horizontal line leftward from the point (6') and drawing a curved line to connect the points (13),(14), (15), (16) and (17), and extending it so as to obtain a point (18) at an intersection point with the horizontal line emanating from the point (6');

a setting a point (19) at the center between the point (6') and the point (18);

drawing a vertical line downward from the point (19) to a point (20) according to a full desired length of the pants from the horizontal line emanating from the point (1');

drawing a horizontal line through the point (20), and setting a point (21) along the vertical line passing upwardly up to the point (19) at a distance according to the depth from the waistline (1) to he calf line (13);

drawing a horizontal line through the point (21);

setting points (22) and (23) therefrom at ¼ of the measure around the calf (13) leftward and rightward, respectively, along the horizontal line passing through the point (21);

setting points (24) and (25) at 1 cm inward, respectively, from the point (6') and the point (18);

setting points (26) and (27) at 1 cm extending outward, respectively, from the points (22) and (23) along said horizontal line passing through the point (21);

setting a point (28) downwardly along said vertical line emanating from the point (19) according to the depth from the waistline (1) to the knee (12), drawing a horizontal line through the point (28) for the measure around the knee (12);

drawing a first line to connect the points (24) and (26) and a second line to connect the points (25) and (27), and extending said first and second lines to obtain points (30) and (29) at the respective intersection points with said horizontal line passing through the point (20);

drawing a line from the point (6') and another line from the point (18) and connecting points (26) and (29), and points (27) and (30), respectively, so as to complete the internal side line and the external side line;

setting a point (31) at 1.3 cm leftward from the point (9) along the horizontal line passing through said point (9), then drawing a vertical line downwardly from the point (31);

setting a point (32) at 2.5 cm below the point (31) along said vertical line emanating from the point (31);

drawing a line from the point (32) to incline leftwardly in a length equal to 1 cm and ¼ of the measure around the hip (4 ) and 1.3 cm, and to intersect with the horizontal line passing through the point (9) so as to obtain a point (38);

setting a point (33) leftwardly along the inclined line emanating from the point (32) at a distance equal to a measure of the horizontal deviation at the back waist line from a line tangential to the back upper thigh (7);

drawing a line from the point (33) and slightly inclined to the vertical through the line between the point (32) and the point (38);

setting a point (34) downwardly along said last-named line at a distance equal to the distance between the points (9) and (2');

setting a point (35) upward along said last-named line at a distance equal to the measure of the back upper thigh (7) and 2.5 cm;

setting a point (36) at 1 cm leftward from the point (32) along the lien connecting the points (38) and (32);

drawing a line to connect points (36) and (35);

setting a point (37) at a distance of 8 cm from the point (36) where said distance intersects with the line that extends downwardly form the points (35) and (32);

setting a point (39) vertically below the point (35) at a distance equal to the distance between the point (1') and (7'); and drawing a line leftward through the point (39) to obtain the position of the lower waist line (2) of the back piece;

drawing a line from the point (39) inclined upwardly to the left to a distance equal to ¼ of the measure around the lower waist line (2) to intersect with the horizontal line emanating from the point (7') so as to obtain therewith an intersection point (40);

setting a point (41) below the point (35) at a distance equal to the distance between the points (1') and (8');

drawing a line from the point (41) for the position of the lower waist line (3) of the back piece, so as to be upwardly inclined at the left and to a distance equal to 0.5 cm and ¼ of the measure around the lower waist line (3) so as to intersect with the horizontal line emanating from the point (8') and so as to obtain an intersection point (42);

drawing a downward line from the point (41) and extending beyond the point (32) to intersect with the horizontal line emanating from the point (10) so as to obtain an intersection point (43);

setting a point (44) leftward along the horizontal lien emanating from the point (10) at a distance equal to 1 cm and ¼ of the measure around the hip (3) and 1.3 cm;

drawing a curved side line to connect points (40), (42), (38), (44) and extending the curved side line downwardly so as to obtain an intersection point (45) on the horizontal line emanating from the point (19);

drawing a line from the point (19) perpendicularly to the line connecting the points (38) and (32) so as to obtain a left bottom outward point (46) on the last-named line and an intersection point (47) as the center point of the bottom piece of the pants;

drawing a central line to connect points (46) and (47); then drawing a line through the point (47) perpendicularly to the central line connecting the points (46) and (47) so as to obtain a point (48) spaced leftward from the point (47) by a distance equal to 2 cm and the distance between the points (20) and (30); and setting a point (49) rightward from the point (47) so as to be mirror-symmetrical with the point (47) with respect to the central line connecting the points (46) and (47);

drawing a line parallel to the central line connecting the points (47) and (46) upwardly from the point (48) so as to obtain therewith an intersection point (51), setting a point (50) rightward from the point (51) and so as to be mirror-symmetrical with the point (51) with respect to the central line connecting the points (46) and (47);

obtaining a point (52) and a point (53) along the horizontal line passing through the point (28) in a manner analogous to that of obtaining the points (50) and (51) with respect to the horizontal line passing through the point (21);

setting points (54') and (55'), respectively, along the line through points (52) and (53), at a location 2 cm outwardly beyond the points (52) and (53), respectively;

setting points (54) and (55), respectively, along the line through points (50) and (51) at a location 2cm outwardly beyond the points (50) and (51), respectively, drawing a line extending rightwardly from the point (37) to a position equal to the distance of ⅝ of the measure around the hip (4) minus 1.3 cm so as to obtain an extreme outward point (56);

drawing a convexly curved internal back side line (57) to connect the point (56) and the point (54');

drawing an initially straight and thereafter convexly curved back gore line (58) to connect the points (35),(39), (41), (32) and (56);

drawing a line from the point (45) parallel with the line connecting the points (54) and (55) to cross with the internal back side line (57) so as to obtain an intersection point (60), the distance between the points (45) and (60) indicating the width of the back piece; and drawing a front side line (61) to connect the points (45), (55), and (48), so as to complete the layout drawing.

2. A method of drawing a model in pants tailoring by means of a measure around the waist line (b), a measure around a lower abdomen (C), a measure (C1) from the waist line (B) to the lower abdomen (C), a measure around an upper abdomen (D), a measure for the depth (D1) from the waist line (B) to the upper abdomen (D), a measure around a central hip (E), a measure (E1) around the bottom of the central hip (E) from an extruding point of the abdomen, a measure for the depth (E2) from the waist line (B) to the central hip (E), a measure around an upper hip (F) located above the hip (E), a measure of the distance (F1) from the waist line (B) to the upper hip (F), a measure around a lower hip (G) located below the center hip (E), a measure of the distance (G1) from the waist line (B) to the lower hip (G), a measure around the middle thigh (H), a measure for the depth (H1) from the waist line (B) to the middle thigh (H), a measure around the knee (I), a measure for the depth (I1) from the waist line (B) to the knee (I), a measure around the calf (J), a measure for the depth (J1) form the waist line (B) to the calf (J), a measure around the ankle (K), a measure for the depth (K1) from the waist line (B) to the ankle K, a measure of the front length (L) from the waistline (B) downward vertically to the horizontal ground, a measure of the side length (M) from one side of the waist line (B) to the horizontal ground, a measure of the back length (N) from the back of the waistline (B) downward vertically to the horizontal ground, a measure of the full length of the gore (O) from the front of the waist line (B) through the bottom of the gore to the back of the waistline (B), a measure of the horizontal deviation (P) from a tangent to the back waist line (B) to a tangent to the hip line (F), and a lateral measure of the side curve (Q) from the waist line (B) through the hip line (E), the steps comprising:

drawing a horizontal line (1');

drawing a vertical line (2') perpendicularly to the horizontal line (1') to cross each other at a left side at an intersection point (3');

setting a point (4') downward from the line (1') along the vertical line (2') at a location equal to the difference between the front length (L) and the side length (M);

setting a point (5') downward along the vertical line (2') from the line (1') at a location equal to the distance of the depth (E2);

drawing a horizontal line (6') leftward from the point (5');

setting a point (7') leftward along the horizontal line (6') from the point (5') at a distance equal to ½ the difference between the measure of (E) and the measure of (E1):

setting a point (9) leftward along the horizontal line (6') from the point (7') at a distance equal to ¼ of the measure (E);

drawing a vertical line (10') through the point (9) to intersect with the horizontal line (1') at a point (11');

setting a point (12') and a point (13'), respectively downward along the vertical lines (10') and (2') from the point (11'), and from the point (4'), at a distance equal to the depth (C1);

drawing a line (14') to connect points (12') and (13');

setting a point (15') and a point (16'), respectively downward along the vertical line (10') and the vertical line (2') from the point (11') and the point (4') at a distance equal to the depth (D1);

drawing a line (17) to connect the point (15') and the point (16');

drawing an oblique line (18) to connect the point (13') and the point (7'), and another oblique line (19) form the point (16') to obtain an intersection point (20) on the line (14');

setting a point (21) downward along the vertical line (10') form the point (11') at a distance equal to the depth (F1); the drawing a horizontal line (22) rightward from the point (21) to intersect with the oblique lines (18) and (19) at the respective intersection points (24) and (23);

setting a point (25) leftwards along the horizontal line (22) from the point (23) or (24) at a distance equal to ¼ of the measure (F);

setting a point (26) leftward along the horizontal line (14') from the point (20) or (13') at a distance equal to ¼ of the measure (G);

setting a point (27) leftward along the line (17) from the point (16') at a distance equal to ¼ of the measure (D);

setting a point (28) leftward along the horizontal line (1') at a distance from the point (3') equal to ¼ of the measure (B);

setting a point (29) downward along the vertical line (2') from the point (4') at a distance equal to 0.5 cm plus the measure (A);

drawing a horizontal line (30) rightward from the point (29);

setting a point (40) rightward from the point (29) along the horizontal line (30) at a distance equal to 1/24 of the measure (E);

setting a point (41) along the horizontal line (30) about 2 cm leftward from the point (40);

drawing a vertical line (42) downward from the point (41);

setting a point (43) along the vertical line (42) at 13.5 cm from the point (41);

setting a point (44) upward along the vertical line (2') from the point (29) at a distance equal to 1/16 of the measure (E) minus 1 cm;

drawing a convexly curved line (45) to connect the point (44) and the point (40);

setting a point (46) along the vertical line (10') downward form the point (11') at a distance equal to the depth (G1);

drawing a line (47) rightward from the point (46) to intersect with the vertical line (8') emanating from the point (7') at an intersection point (48);

setting a point (49) along the horizontal line (47) leftward from the point (48) at a distance equal to ¼ of the measure (G);

drawing a line (50) downward from the point (40) passing through the point (43);

setting a point (51) along the vertical line (10') downward from the point (11') at a distance equal to the depth (H1);

drawing a horizontal line (52) rightward from the point (51) to intersect with the line (50) at an intersection point (53);

drawing a line (54) downwardly form the point (9) passing through the point (46) or (49) to later intersect the horizontal line (52) at an intersection point (55);

setting a point (56) at the center between the point (55) and the point (53) along the horizontal line (52);

drawing a vertical line (57) downward from the point (56) to a horizontal line selected to serve as the bottom of the pants;

setting a point (58) along the vertical line (57) at a distance equal to the depth (I1) from the horizontal line (1');

drawing a horizontal line (59) through the point (58);

setting a point (60) along the vertical line (57) at a distance equal to the depth (K1) from the horizontal lien (1');

drawing a horizontal line (61) through the point (60);

setting a point (62) at 2.5 cm below the point (60) along the vertical line (57);

drawing a line (63) horizontally through the point (62);

setting a point (64) at 2 cm leftward from the point (62) along the horizontal line (63); then drawing a line (65) to connect the point (56) and the point (64);

setting a point (66) downward along the vertical line (65) from the horizontal line (1') at a distance equal to the depth (J1);

drawing a first horizontal line (67) and a second horizontal line (68) through the point (66) in respective opposite directions;

setting a left point (70) and a right point (69) along respective lines (67) and (68) from the point (66) at a distance equal to ¼ of the measure (J);

setting a point (32) and a point (71) respectively leftwardly and rightwardly along the horizontal line (63) from the point (64) at a distance of 8.5 cm;

setting a point (72) rightward from the point (69) along the line (68) at a distance of 2 cm;

drawing an oblique line (73) to connect the point (71) and the point (72);

drawing a line perpendicularly to the line (73) from the point (64) so as to obtain an intersection point (74) on the oblique line (73);

drawing a connection line to connect the oblique line (73) and the line (50) so as to complete an internal side line (75) for the front piece, an intersection point between the internal side line (75) and the horizontal line (59) being the point (76);

setting a point (77) at a distance of 2 cm leftward from the point (70) along the line (67);

drawing a line (78) to connect the point (32) and the point (77);

drawing another line (79) upwardly from the point (77) to the point (55), thereby extending the line (78) so as to complete the external side line;

obtaining an intersection point (80) at the intersection of the line (79) and the line (59);

drawing a straight line from the point (64) at right angles to a downward extension of the line (78) so as to intersect the latter at an intersection point (81);

setting a point (82) leftward from the point (7') along the horizontal line (6') at a distance equal to ½ of the measure (P);

setting a point (83) below the horizontal line (1') along the vertical line passing through the point (56) at a distance equal to the difference between the measure (N) and the measure (M);

drawing a horizontal line (121) rightwardly from the point (83) and a vertical line (84) upwardly from the point (82) so as to obtain an intersection point (85) at the intersection of the lines (121) and (84);

drawing a convexly curved line close to the vertical line (84) from a point 4 cm below the point (85), and passing through the point (7') to form a gore line (86) for the back piece;

setting a point (87) along the line (84) downward from the point (85) at a distance equal to the measure (D1); and drawing an inclined line (88) to connect the points (87) and (15);

setting a point (89) leftward from the point (87) along the inclined line (88) at a distance ¼ of the measure (D);

setting a point (90) downward from the point (85) along the gore line (86) at a distance equal to the measure (C1);

drawing from the point (90) an inclined line (91) to the point (12');

setting a point (92) leftward from the point (90) along the line (91) at a distance equal to ¼ of the measure (C);

setting an intersection point (93) between the gore line (86) and the horizontal line (22);

setting a point (94) leftward from the point (93) along the horizontal line (22) at a distance equal to ¼ of the measure (F);

setting a point (95) along the horizontal line (47) so as to intersect with the gore line (86);

setting a point (96) leftward from the point (95) along the horizontal line (47) at a distance equal to ¼ of the measure (G);

setting a point (97) leftward from the point (64) along the line (63), at distance of 1.5 cm;

drawing an oblique line (98) from the point (56) to the point (97);

drawing a line to connect the point (97) and the point (74);

setting a point (99) at a distance of 8.5 cm from the point (97) along the line (63);

setting a point (100) leftward from the point (97) along the line (63) at a distance of 8.5 cm;

setting a point (102) leftward from the point (77) along the line (67) at a distance equal to that between the point (66) and the point (77) of the front piece;

drawing a straight line (101) to connect the points (100) and (102);

drawing a side line (103) in continuation of the side line (45) and the straight line (101) so as to merge the side line (54) with the straight line (101), an upward extension of the side line (54) terminating at the point (9);

drawing a concave curved line (104) to connect the points (26) and (9), so that the distance between the last-named points is equal to ¼ of the measure (C), thereby obtaining the correct length of the waist line;

setting an intersection point (105) of the curved line (104) and the horizontal line (1');

setting what is for all intents and purposes an intersection point of the curved line (104) with the lines (88) and (17) as the intersection point (107);

drawing a convexly curved line (108) from the point (9) to the horizontal line (1') to set a point (109), of the front piece as well as of the back piece;

setting an intersection point of the side line (108) and the horizontal line (22) as the intersection point (110);

setting a merging region of the side line (108) and the inclined lines (14') and (91) as to what amounts to all intents and purposes, an intersection point (111);

setting a merging region of the side line (108) and the inclined lines (17) and (88) as to what is substantially, for all intents and purposes, an intersection point (112);

drawing a convexly curved line (113) to connect the points (4') and (109);

drawing a convexly curved line (115) form the point (109) so as to be tangent to a prearranged length of the horizontal line (121), said prearranged length extending leftwardly from the point (83), along the line (121) to a point (114), and being about 1/20 of the length of the line (121);

drawing said convexly curved (115) so as to smoothly connect said prearranged length of the horizontal line which extends from the point (83) to the point (114);

setting a point (116) rightward from an intersection point (124) of the line (68) and the line (98) along the line (68) at a distance equal to the distance between the point (66) and the point (77) in the front piece;

drawing a straight line (117) to connect the points (99) and (116);

drawing a bottom line (122) perpendicularly to the line (117) so that the last-named two lines meet at an intersection point (118);

according to the distance equal to the difference between the measure (O) and the length of the gore in the front piece, drawing a line from the point (4') through to the point (44) to connect the upper end of the curved line (45) to the point (44);

for the length of the gore in the back piece, drawing a line from the point (85) through the line (86), namely through the point (87), the point (90), the point (93) and the point (7'), and extending it outwardly rightwards to a pint (119) in an arcuate shape to complete a gore line for the back piece;

according to the internal side length of the front piece drawing a line upwardly from the point (74) through the point (72) on the line (73) so as to connect the line (43), being an upward continuation of the line (73), up to the point (40) to complete a first internal side line (123) for the back piece; and drawing a curved line upwardly from the intersection point (118) through the point (116) up to the point (119), so as to complete a second internal side line (120) for the back piece, thereby completing the basic model (S) for the back piece.

* * * * *